US005156543A

United States Patent [19]

Jeung

[11] Patent Number: 5,156,543

[45] Date of Patent: Oct. 20, 1992

[54] LIQUID FUEL COMBUSTOR WITH AN IMPROVED BURNER ASSEMBLY

[75] Inventor: Seung-Gyo Jeung, Suwon, Rep. of Korea

[73] Assignee: Samsung Electronics Co., Ltd., Kyonggi-Do, Rep. of Korea

[21] Appl. No.: 738,539

[22] Filed: Jul. 31, 1991

[30] Foreign Application Priority Data

Jul. 31, 1990 [KR] Rep. of Korea ..... 90-11463

[51] Int. Cl.[5] ..... F23D 11/44

[52] U.S. Cl. ..... 431/208; 431/214; 431/335

[58] Field of Search ..... 431/207, 208, 218, 340, 431/338, 332, 335, 330, 333; 126/93, 95, 97, 84

[56] References Cited

U.S. PATENT DOCUMENTS 1,573,480 2/1926 Connor ..... 431/214
1,582,106 4/1926 Weddington ..... 431/214
2,250,304 7/1941 Keating et al. ..... 431/335
3,734,677 5/1973 Murase ..... 431/208

FOREIGN PATENT DOCUMENTS 89609 7/1980 Japan ..... 431/208
58-88525 5/1983 Japan .
153309 6/1988 Japan ..... 431/208
310212 12/1989 Japan ..... 431/208

*Primary Examiner*—James C. Yeung
*Attorney, Agent, or Firm*—Burns, Doane, Swecker & Mathis

[57] ABSTRACT

A liquid fuel combustor comprises a gasification promoter unit housed within a heated burner body for enhancing the gasification capability of the atomized fuel. The gasification promoter unit is provided with a downwardly convex surface. A fuel nozzle has its outlet facing toward that surface to direct fuel thereagainst. A heater is embedded in the promoter unit to heat the fuel particulates emerging from the fuel nozzle.

13 Claims, 4 Drawing Sheets

LIQUID FUEL COMBUSTOR WITH AN IMPROVED BURNER ASSEMBLY

FIELD OF THE INVENTION

The present invention relates to a liquid fuel combustor.

DESCRIPTION OF THE PRIOR ART

Japanese Patent Publication No. 58-88525 discloses a typical liquid fuel combustor comprising, as shown in FIG. 1, an ultrasonic atomizer 9 disposed to feed fuel particulates into the gasification chamber 2 defined by a circular burner wall 1. Formed through the atomizer 9 is a fuel flow path 11 which is exposed to the gasification chamber 2 at its one end and coupled, at the other end, to a fuel supply line (not shown) which in turn is connected to a fuel pump. The atomizer 9 has a radial inner end extending through an opening 6 toward the gasification chamber 12. Further, the burner wall 1 includes a pair of combustion air inlets 12 and 13 lying perpendicularly to the atomizer 9 in a common plane (i.e., the plane of the paper).

These combustion air inlets 12 and 13 faces toward one another, with their axes offset one another to a predetermined extent. A conventional blower 7 supplies a controlled amount of pressurized air into the gasification chamber 2 through an air supply pipe 15 and then through the opening 6 as well as combustion air inlets 12 and 13.

During operation of such a liquid fuel combustor as set forth above, an increase in the gasification chamber temperature to a certain level will cause the fuel pump to feed liquid fuel to the radial inner end of the atomizer 9 via the fuel flow path 11.

Since the atomizer 9 has an ultrasonic oscillation circuit for generation of an ultrasonic field, the liquid fuel reaching the radial inner end of the atomizer 9 is subject to an atomization effect and then introduced into the gasification chamber in a particulate state. A relatively small amount of air flowing through the smaller diameter pipe 16 assists to direct the atomized fuel particulate to the gasification chamber 2. Another portion of the combustion air supplied from the blower 7 is admitted into the gasification chamber 2 through the upper combustion air inlet 12, with the remaining portion of the combustion air admitted through the lower combustion air inlet 13. As described earlier, because the axes of the upper and lower inlets are offset from one another in a common plane and perpendicular to the axis of the atomizer 9, the combustion air admitted through each of the inlets tends to form a spiral vortex with the fuel particulate.

The conventional liquid fuel combustors of the construction explained above, however, are disadvantageous in many respects. Specifically, when the liquid fuel combustor is in use for a long period of time, non-gasified fuel particulate or tar produced in the process of fuel combustion tends to be deposited on the bottom surface of the gasification chamber 2.

Not only does the deposited material create white gas at the initial stage of ignition but it also produces a yellow flame or soot containing a variety of toxic emissions, e.g., CO, CO2, NO, NO2 and the like, thereby polluting the indoor air around the fuel combustor or heater. Moreover, an increase in the amount of foreign materials deposited on the bottom surface of the gasification chamber 2 often results in a lowering of the temperature at the particulate landing region, which may lead to an incomplete gasification of the atomized fuel.

SUMMARY OF A PREFERRED EMBODIMENT OF THE INVENTION

Accordingly, it is a principle object of the present invention to provide a liquid fuel combustor which is able to minimize the amount of tar materials or fuel impurities deposited on the bottom surface of the burner assembly, thereby preventing temperature fluctuations at the fuel particulate impinging region, as well as making it possible to perform a complete gasification and hence an effective combustion of the atomized fuel particulates. With this object in view, the present invention provides a liquid fuel combustor comprising a burner body having a bottom wall and a cylindrical side wall extending vertically upwardly from the bottom wall. The walls defining a bowl-shaped gasification chamber, said side wall has. A first sheath heater embedded therein in a circumferential direction; a burner head is located on the top end of a burner body, the burner head having an array of flame generation holes distributed along the circumference thereof. A throttling member is attached to the lower surface of the burner head for directing the air-fuel mixture to the flame generation holes. A nozzle assembly is mounted through the side wall of the burner body for feeding liquid fuel and combustion air into said gasification chamber to produce the air-fuel mixture. The nozzle assembly includes an air nozzle connected through an air pipe to said blower and a fuel nozzle extending into the gasification chamber and connected through an oil pipe to the fuel pump. A gasification promoter unit is housed within the gasification chamber. The promotor unit includes a central hemisphere and a pair of support legs for holding the hemisphere in position. The hemisphere has a downwardly convex surface. The outlet of the fuel nozzle is oriented to face the convex surface of said hemisphere.

BRIEF DESCRIPTION OF THE DRAWINGS

Other features and objects of the present invention will become apparent from the following description of the preferred embodiment taken in conjunction with the accompanying drawings.

DETAILED DESCRIPTION OF THE PREFERRED EMBODIMENT

Figure 1:
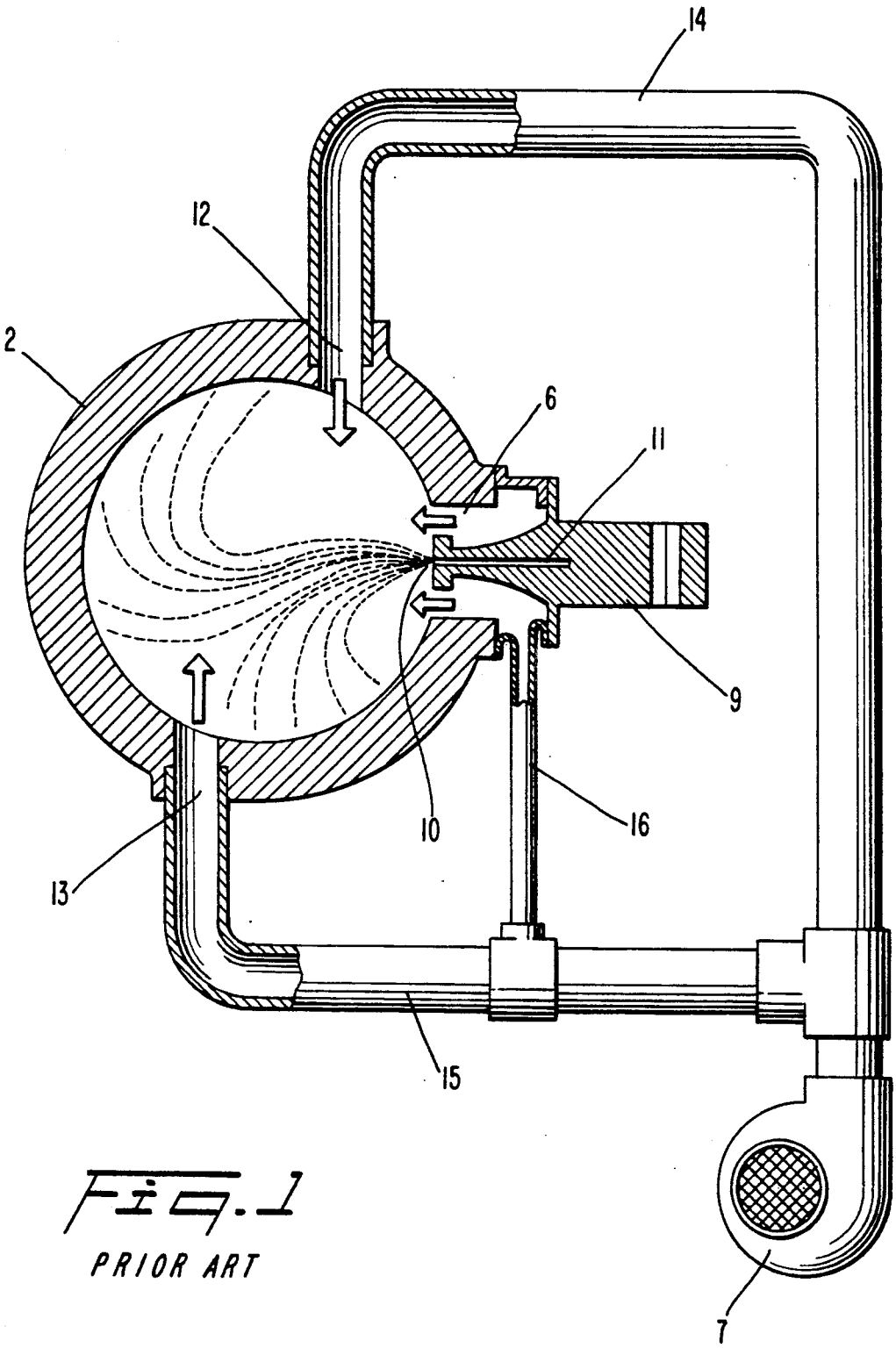
Fig. 1 PRIOR ART
FIG. 1 is a horizontal sectional view through a conventional liquid fuel combustor, with portions thereof removed for clarity and simplicity.
Figure 2:
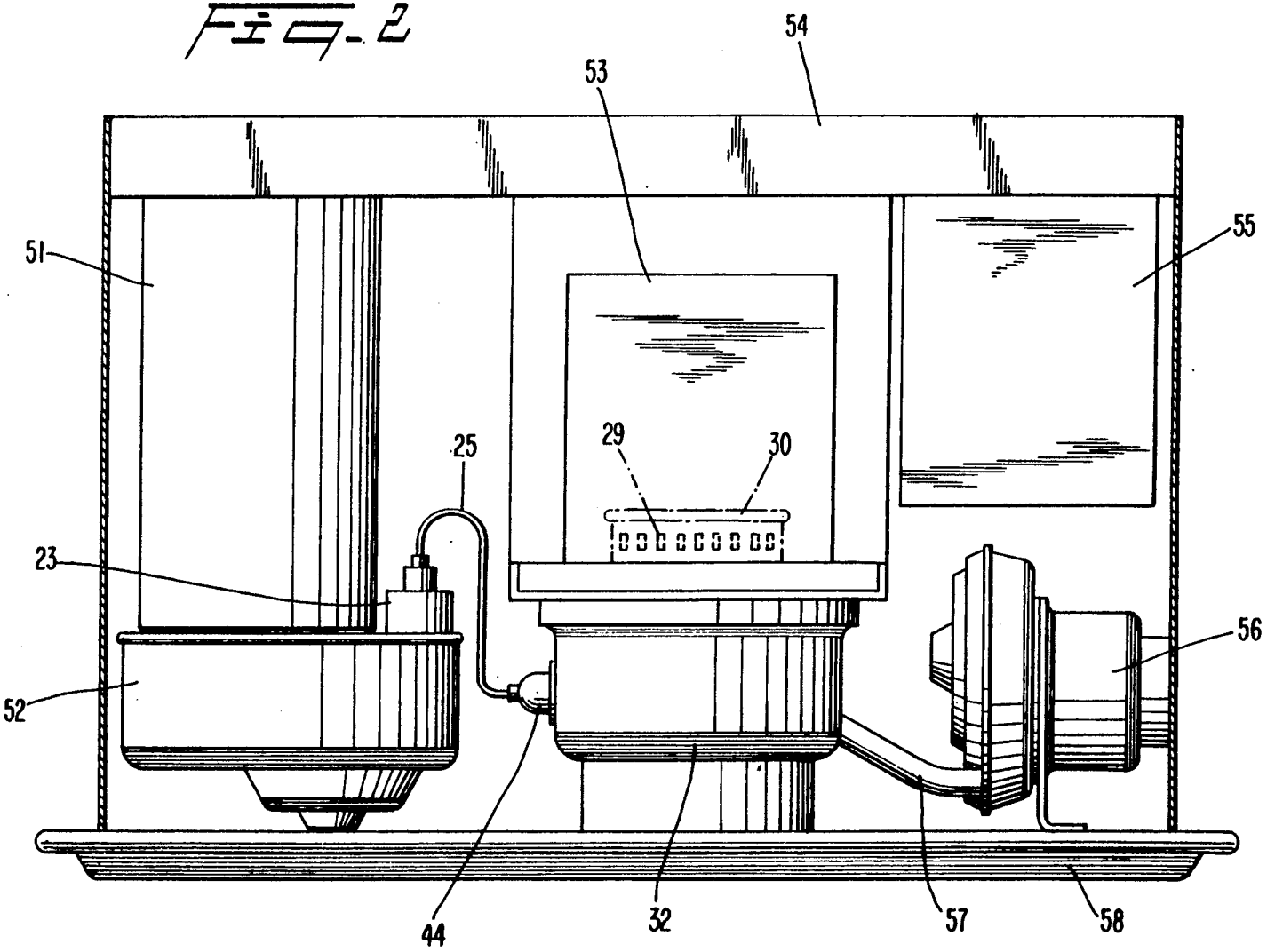
FIG. 2 is a schematic view illustrating the overall construction of a liquid fuel combustor in accordance with the present invention.
Figure 3:
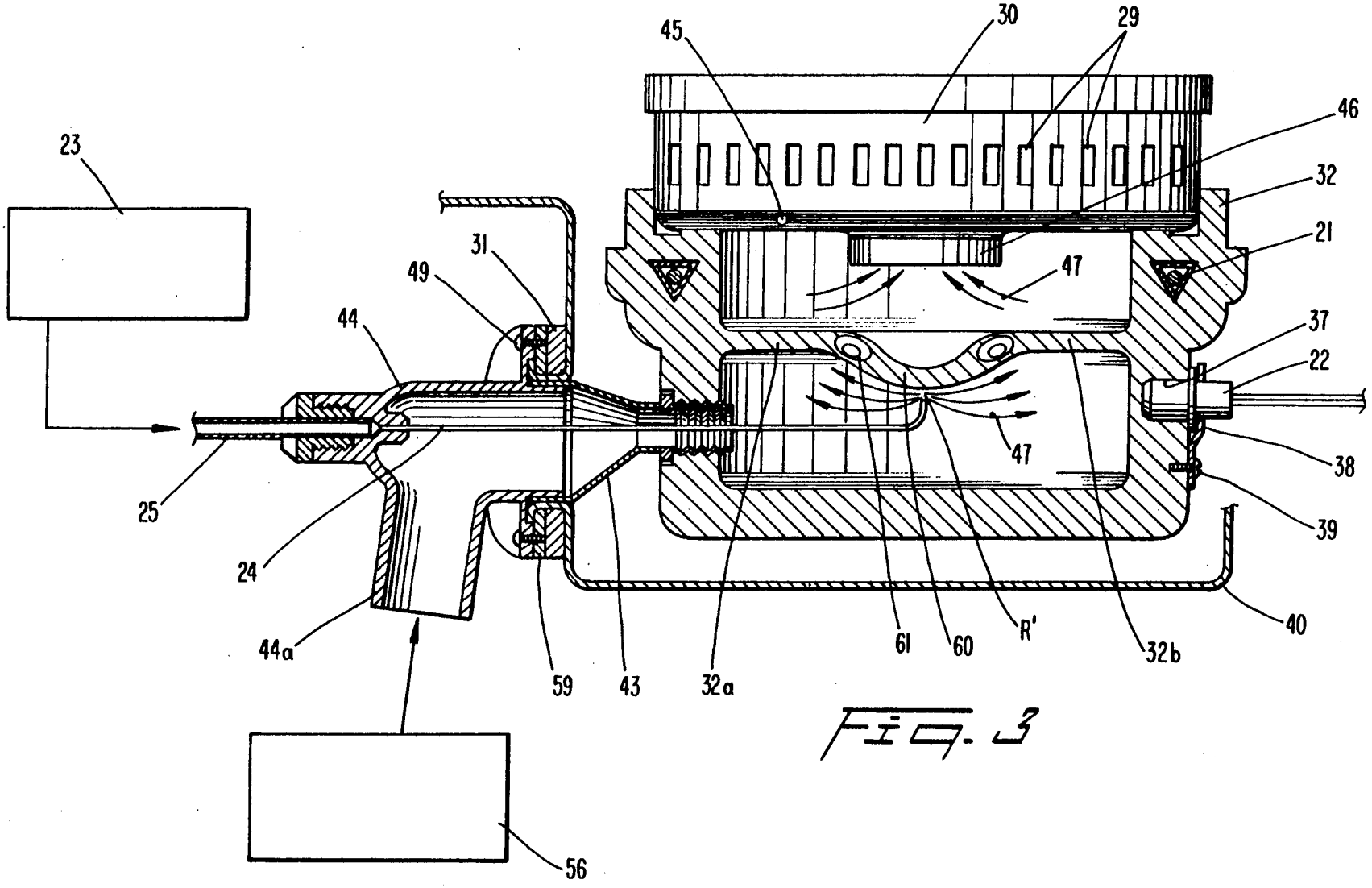
FIG. 3 is a vertical sectional view through the burner assembly incorporated in the liquid fuel combustor according to the present invention.

Referring now to FIGS. 2 and 3, there is shown a liquid fuel combustor of the present invention which comprises a first sheath heater 21 a second sheath heater 61 connected to a power source for increasing the temperature of the gasification chamber defined within the burner body 32. If the gasification chamber is preheated to a given temperature, a microprocessor constituting the control part 55 will come into operation to make the blower 56 provide combustion air into the gasification chamber through an air hose 57 and inlet pipe 44*a*. At this moment, the fuel pump 23 begins to suck up a controlled volume of liquid fuel from the oil reservoir 52 and then deliver it via oil pipe 25 to a fuel nozzle 24 of the nozzle assembly 44 which acts to spray liquid fuel toward the impinging region R' on the a downwardly convex surface of the gasification promoter unit 60 in an atomized state. The atomized fuel is subsequently mixed with the combustion air supplied through the inlet pipe 44*a* while being subject to gasification with the aid of thermal energy. The resulting air-fuel mixture will be directed to an array of flame generation holes 29 that are arranged to produce uniform flame upon ignition of the air-fuel mixture. As known in the art, a variety of information data indicative of operating condition or indoor temperature may be displayed on the display part 54 through the use of, e.g., liquid crystal display elements or light emitting diodes under a control of the control part 55. It should be appreciated that the oil reservoir 52, the burner body 32 and the blower 56 are all carried by a single base plate 58 as best shown in FIG. 2.

Figure 4:
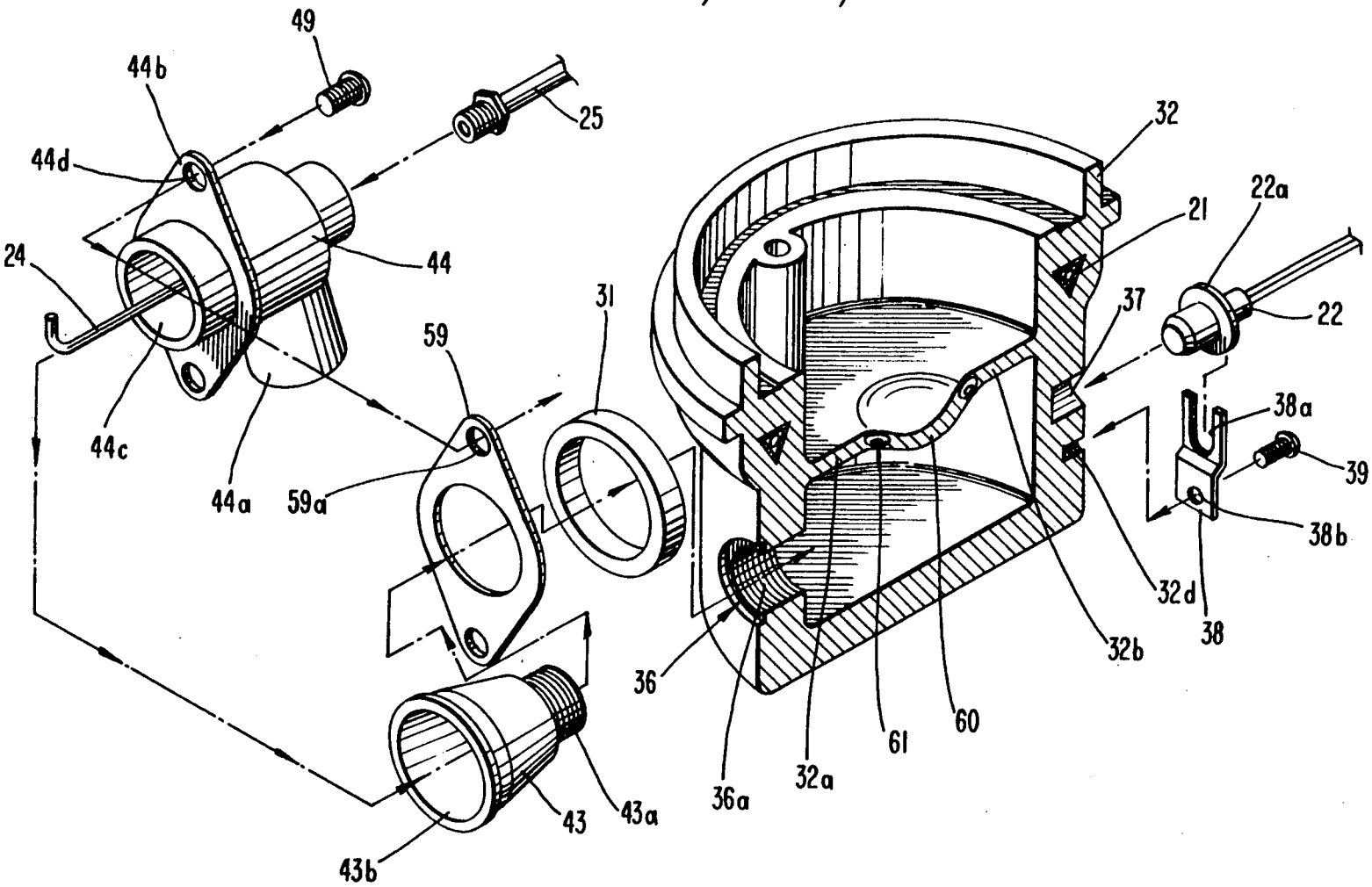
FIG. 4 is an exploded perspective view of the burner assembly shown in FIG. 3, with a portion of the burner body removed for clarity.

With reference to FIGS. 3 and 4, there is shown in detail a burner assembly for use in the liquid fuel combustor in accordance with the present invention. The burner assembly includes a burner body 32 of bowl shape having a first sheath heater 21 embedded therein in an circumferential direction. Positioned below the first sheath heater 21 is a gasification promoter unit 60 which comprises a central hemisphere having a downwardly convex surface. The central hemisphere is supported from the inner surface of the burner body 32 by a pair of support legs 32*a* and 32*b*. Embedded in the hemisphere along its circumference is a second sheath heater 61 which is electrically connected to a power supply via a head wire (not shown) passing through either of support legs 32*a* and 32*b*. Located on the top end of the burner body 32 is a burner head 30 having an array of equally spaced flame generation holes 29. A throttling member 46 is attached to the burner head 30 by means of screws 41 so as to direct the air-fuel mixture to the flame generation holes 29 through a central throttling path, as illustrated in FIG. 3. The burner body 32 has a threaded opening 36 into which an air nozzle 43 of larger diameter is threadedly engaged as shown in FIG. 3. Connected to the air nozzle 43 is a nozzle assembly 44 which comprises an air inlet pipe 44*a* associated with blower 56 and a fuel nozzle 24 associated with the fuel pump 23 through an oil pipe 25. The fuel nozzle 24 is disposed in a horizontal direction and extends into the gasification chamber, with the inner end thereof bent in an upward direction.

Specifically, the air nozzle 43 is attached to the burner body 32 by way of inserting a bracket 59 and a packing 31 around the air nozzle 43, positioning the air nozzle 43 into the larger diameter hole of the burner cover 40 and finally effecting a threaded engagement between the external thread 43*a* of the air nozzle 43 and the internal thread 36*a* of burner body 32. As a result, the packing 31 forms a hermetic seal between the bracket 59 and the burner cover 40 and hence prevents the exterior space from communicating with the interior space separated by the burner cover. The nozzle assembly 44 is then fastened to the air nozzle 43 by virtue of threading a screw 42 into the thread holes 44*d* and 59*a*.

It should be noted that the elongate fuel nozzle 24 having an upward inner end is to be positioned in place prior to attaching the nozzle assembly 44 to the burner body 32, with the oil pipe 25 being coupled to the nozzle assembly through the use of a coupling member 25*a*. This will make it possible to form a length of fuel flow path for feeding the pressurized liquid fuel from the fuel pump 23 to the fuel nozzle 24 from which the liquid fuel is sprayed toward the fuel impinging region R' of the gasification promoter unit 60.

In addition, a temperature sensor 22 is seated in a recess 37 formed through the wall of the burner body 32. This temperature sensor 22 may be held in place by means of a bracket 38 which has a slot 38*a* opened at its top end. When a screw 39 is inserted through a screw hole 38*b* of the bracket 38 and then threaded into a fastening hole 32*d* of the burner body 32, the bracket 38 acts to press the flange 22*a* of the temperature sensor 22 against the burner body 32 so that the temperature sensor 22 can be secured in place.

In operation, if the blower 56 is plugged into a power supply, the combustion air is fed into the gasification chamber through the inlet pipe 44*a* and air nozzle 43, then forming an upward air flow under the heating action of the first and second sheath heaters 21 and 26. At this moment, the fuel pump 23 begins to operate to suck up a volume of liquid fuel and feed the pressurized liquid fuel through the oil pipe 25 to the fuel nozzle 24 from which the liquid fuel is sprayed toward the hemisphere of the gasification promoter unit 60 before it is mixed with the combustion air to form the air-fuel mixture.

A portion of the fuel particulates impinges on the oil impinging region R' and will be heated by the second sheath heater 61 and gasified in its entirety, after which the gasified fuel forms an upward stream with the combustion air. This air-fuel stream flows upwardly through the passage way indicated by arrows 47 and finally reaches the flame generation holes 29 of the burner head 30 at which the air-fuel stream is ignited and burned to produce thermal energy.

In contrast, the remaining portion of the fuel particulates sprayed toward but failing to reach the oil impinging region R' will be difused within the gasification chamber and heated by the first sheath heater 21 so as to be gasified before the formation of an air-fuel stream. This stream also flows upwardly as set forth above and experiences a combustion process at the burner head 30. In such a manner, the fuel particulates are burned in their entirety without generating tar materials and/or nongasified fuel impurities. Accordingly, it is possible to inhibit deposition of foreign materials on the bottom wall of the burner body 32, and thereby minimize any undesirable temperature fluctuations within the gasification chamber, which would otherwise be a cause of generating toxic emissions, soots, yellow flame and the like.

In a nutshell, the first sheath heater 21 cooperates with the second sheath heater 61 embedded in the gasification promoter unit 60 to maintain an optimal temperature condition, e.g. 280° C. within the gasification chamber. Under the optimal temperature condition, a complete gasification and combustion of the fuel particulates is obtainable, which means that little or no foreign material is deposited on the bottom surface of the burner body, and further that the liquid fuel combustor in accordance with the present invention can be used for an extended period of time without having to clean up the burner assembly.

While the present invention has been described with reference to a particular embodiment, it should be apparent to one skilled in the art that many changes and modifications may be made without departing from the spirit and scope of the invention as defined in the claims.

What is claimed is:

1. A liquid fuel combustor having a burner assembly for burning an air-fuel mixture to produce thermal energy, said burner assembly comprising:

a burner body including a wall defining a bowl-shaped gasification chamber;

a gasification promoter housed within said gasification chamber, said gasification promoter including a stationary downwardly convex surface; heating means for heating said wall and said convex surface to a temperature for gasifying a liquid fuel;

nozzle means mounted at said wall of said burner body for feeding liquid fuel and combustion air into said gasification chamber to produce an air-fuel mixture therein, said nozzle means including a fuel nozzle extending into said gasification chamber and having an outlet oriented to face said heated convex surface to spray liquid fuel thereagainst so that liquid fuel contacting said heated convex surface is gasified;

a burner head disposed above and communicating with said burner body, said burner head having flame generation holes; and throttling means for directing the mixture of air and gasified fuel relative to said flame generation holes.

2. A liquid fuel combustor according to claim 1, wherein said convex surface is joined to said wall by at least one support leg; said wall, said at least one leg, and said convex surface all being of one piece construction, said convex surface being spaced below said burner to form a space therebetween which is surrounded by said wall.

3. A liquid fuel combustor according to claim 2, wherein a portion of said nozzle means penetrates said wall and includes an air nozzle arranged coaxially relative to said fuel nozzle.

4. A liquid fuel combustor according to claim 3, wherein said outlet of said fuel nozzle is directed toward a center of said convex surface.

5. A liquid fuel combustor according to claim 1, wherein said heating means constitutes first heating means; second heating means being provided for heating said gasification chamber separately of said first heating means.

6. A liquid fuel combustor according to claim 5, wherein said second heating means is embedded within said gasification promoter.

7. A liquid fuel combustor according to claim 6, wherein said second heating means encircles said downwardly convex surface.

8. A liquid fuel combustor according to claim 7, wherein said downwardly convex surface is generally of hemispherical shape.

9. A liquid fuel combustor according to claim 6, wherein said first heating means is embedded in said wall.

10. A liquid fuel combustor according to claim 9, wherein said first heating means encircles said gasification chamber, and said second heating means encircles said downwardly convex surface.

11. A liquid fuel combustor according to claim 1, wherein said gasification promoter is arranged substantially horizontally centrally within said gasification chamber and is connected to said wall by at least one support leg.

12. A liquid fuel combustor according to claim 1, wherein a space is formed in said gasification chamber between said downwardly convex surface and said throttle, said heater surrounding said space.

13. A liquid fuel combustor having a burner assembly for burning an air-fuel mixture to produce thermal energy, said burner assembly comprising:

a burner body including a wall defining a bowl-shaped gasification chamber;

nozzle means mounted at said wall of said burner body for feeding liquid fuel and combustion air into said gasification chamber to produce an air-fuel mixture therein, said nozzle means including a fuel nozzle extending into said gasification chamber;

first heating means for heating said wall and air-fuel mixture disposed in said gasification chamber;

a burner head communicating with said burner body, said burner head having flame generation holes;

throttling means for directing the air-fuel mixture relative to said flame generation holes;

a gasification promoter housed within said gasification chamber, said gasification promoter including a downwardly convex surface;

said fuel nozzle including an outlet oriented to face said convex surface to direct fuel thereagainst; and second heating means embedded within said gasification promoter for heating said gasification chamber separately of said first heating means.

* * * * *